US010266985B2

(12) United States Patent
Vaidhyanathan et al.

(10) Patent No.: US 10,266,985 B2
(45) Date of Patent: Apr. 23, 2019

(54) COLLAPSIBLE DRYING RACK FOR LAUNDRY DRYER

(71) Applicant: Samsung Electronics Co., Ltd., Suwon-si (KR)

(72) Inventors: Raveendran Vaidhyanathan, Mountain View, CA (US); Viktor Kopyrin, Mountain View, CA (US); Seong Min Oak, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 186 days.

(21) Appl. No.: 15/173,490

(22) Filed: Jun. 3, 2016

(65) Prior Publication Data

US 2017/0350062 A1 Dec. 7, 2017

(51) Int. Cl.
*D06F 58/04* (2006.01)
*D06F 58/20* (2006.01)

(52) U.S. Cl.
CPC ..... *D06F 58/04* (2013.01); *D06F 58/20* (2013.01)

(58) Field of Classification Search
CPC ..... D06F 58/04; D06F 58/20
USPC ..... 34/90, 595–610; 68/19, 20
See application file for complete search history.

(56) References Cited

U.S. PATENT DOCUMENTS 4,081,915 A * 4/1978 Materniak nee Babcerowicz ..... D06F 58/20 285/9.1
4,091,548 A * 5/1978 Daily ..... D06F 58/04 312/311
4,908,959 A * 3/1990 Kretchman ..... D06F 58/04 34/104
D314,262 S * 1/1991 Kretchman ..... D32/25
5,743,025 A * 4/1998 Jordan, Jr. ..... D06F 58/04 34/600
5,778,556 A * 7/1998 Ohsugi ..... A43D 3/1408 211/34
5,894,680 A * 4/1999 Dalvy ..... A43B 7/28 34/104
5,974,693 A * 11/1999 Richards ..... D06F 58/04 34/184
5,987,773 A * 11/1999 Lipscy ..... D06F 59/06 34/106
6,026,592 A * 2/2000 Herr ..... D06F 58/04 34/446

(Continued)

FOREIGN PATENT DOCUMENTS

EP 1777334 A3 * 12/2007 ..... D06F 58/04
JP 2007082833 A 4/2007

(Continued)

*Primary Examiner* — Stephen M Gravini

(57) ABSTRACT

A drying apparatus for use with a laundry dryer includes a first section and a second section. Each section has a plurality of walls defining a cavity, the cavity comprising a portion of a channel for air flow. A first wall among the plurality of walls has a substantially flat exterior surface and a plurality of openings extending through the first wall from the exterior surface to the portion of the channel. The first section and the second section are configured to be disposed substantially adjacent to each other to form the channel. The first section comprises an air outlet cover at a first end, the air outlet cover configured to substantially cover an air outlet of the laundry dryer.

20 Claims, 14 Drawing Sheets

(56) References Cited

U.S. PATENT DOCUMENTS

| | | | | | |
|---|---|---|---|---|---|
| 6,115,936 | A * | 9/2000 | Arlie | D06F 58/04 | 34/106 |
| 6,732,447 | B2 * | 5/2004 | Tomasi | D06F 58/04 | 34/106 |
| 6,915,593 | B2 * | 7/2005 | Gruble | D06F 58/04 | 34/595 |
| 7,007,409 | B2 * | 3/2006 | Moschutz | D06F 58/04 | 34/602 |
| 7,421,804 | B1 * | 9/2008 | Hession | D06F 58/20 | 34/601 |
| 7,552,545 | B2 * | 6/2009 | Crawford | D06F 58/04 | 34/192 |
| 7,591,082 | B2 * | 9/2009 | Lee | D06F 58/04 | 34/237 |
| 8,015,727 | B2 * | 9/2011 | Lee | D06F 58/04 | 156/111 |
| 8,087,184 | B2 * | 1/2012 | Banta | D06F 58/04 | 34/600 |
| 8,347,523 | B2 * | 1/2013 | Chung | D06F 58/04 | 34/130 |
| 9,435,070 | B2 * | 9/2016 | Bae | D06F 58/28 | |
| 9,816,223 | B2 * | 11/2017 | Bae | D06F 58/22 | |
| 9,822,479 | B2 * | 11/2017 | Bae | D06F 58/04 | |
| 2007/0089316 | A1 * | 4/2007 | Kim | D06F 58/04 | 34/82 |
| 2017/0350062 | A1 * | 12/2017 | Vaidhyanathan | D06F 58/20 | |

FOREIGN PATENT DOCUMENTS

| | | | | |
|---|---|---|---|---|
| JP | 2007244658 | A | 9/2007 | |
| KR | 20080010703 | A | 1/2008 | |
| KR | 101225502 | B1 * | 1/2013 | D06F 58/04 |

* cited by examiner

COLLAPSIBLE DRYING RACK FOR LAUNDRY DRYER

TECHNICAL FIELD

This disclosure relates generally to laundry dryer appliances and more specifically to a collapsible drying rack for a laundry dryer.

BACKGROUND

Laundry dryers are used throughout the world to automate and reduce the effort associated with cleaning laundry. Most laundry dryers incorporate a drum that rotates and tumbles the laundry to be dried as heated air circulates around the laundry. However, some laundry items, including delicate clothing or heavy, bulky items, should not be tumbled. For such items, a drying rack can be used.

SUMMARY

This disclosure provides a collapsible drying rack for use with a laundry dryer.

In a first embodiment, a drying apparatus for use with a laundry dryer is provided. The drying apparatus includes a first section and a second section. Each section has a plurality of walls defining a cavity, the cavity comprising a portion of a channel for air flow. A first wall among the plurality of walls has a substantially flat exterior surface and a plurality of openings extending through the first wall from the exterior surface to the portion of the channel. The first section and the second section are configured to be disposed substantially adjacent to each other to form the channel. The first section comprises an air outlet cover at a first end, the air outlet cover configured to substantially cover an air outlet of the laundry dryer.

In a second embodiment, a laundry dryer is provided. The laundry dryer includes a drum, an air outlet, and a removable drying rack configured to be installed inside the drum. The drying rack includes a first section and a second section. Each section has a plurality of walls defining a cavity, the cavity comprising a portion of a channel for air flow. A first wall among the plurality of walls has a substantially flat exterior surface and a plurality of openings extending through the first wall from the exterior surface to the portion of the channel. The first section and the second section are configured to be disposed substantially adjacent to each other to form the channel. The first section comprises an outlet cover at a first end, the outlet cover configured to substantially cover the air outlet.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Various functions described below can be implemented or supported by a processor coupled to a computer readable medium storing one or more computer programs. As such, the processor is a special purpose processor for performing the functions defined by the one or more computer programs.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 13, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged device or system.

Many laundry dryers are configured to accept a drying rack to dry delicate items like sweaters or other items such as shoes in a static position, as tumbling of these items could result in shrinkage, noise, or possibly even damage to the dryer drum. However, current drying racks do not promote air movement around the rack, so the drying effectiveness of these drying racks can be limited. In addition, these drying racks are bulky and can be difficult to store outside of the dryer when not in use.

To address these and other issues, embodiments of this disclosure provide multiple collapsible drying racks that promote additional air flow around the drying rack, thus resulting in improved drying effectiveness and a faster drying time. For example, some tests indicate over six times faster drying of flat items such as sweaters when used with one of the disclosed drying racks. Additionally, since the disclosed drying racks are collapsible, they can be stored in a smaller configuration outside of the dryer when not in use.

Figure 1:
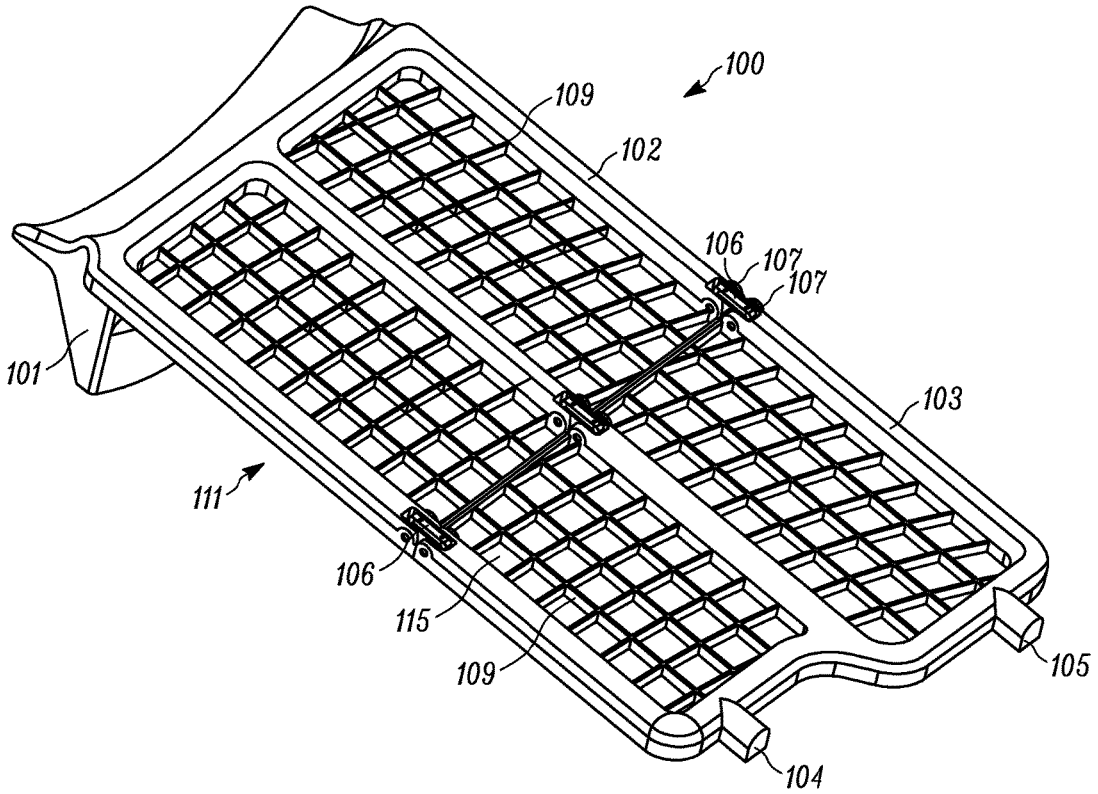
FIGS. 1 through 5 illustrate different views of an example folding drying rack for use with a laundry dryer according to this disclosure.
Figure 2A:
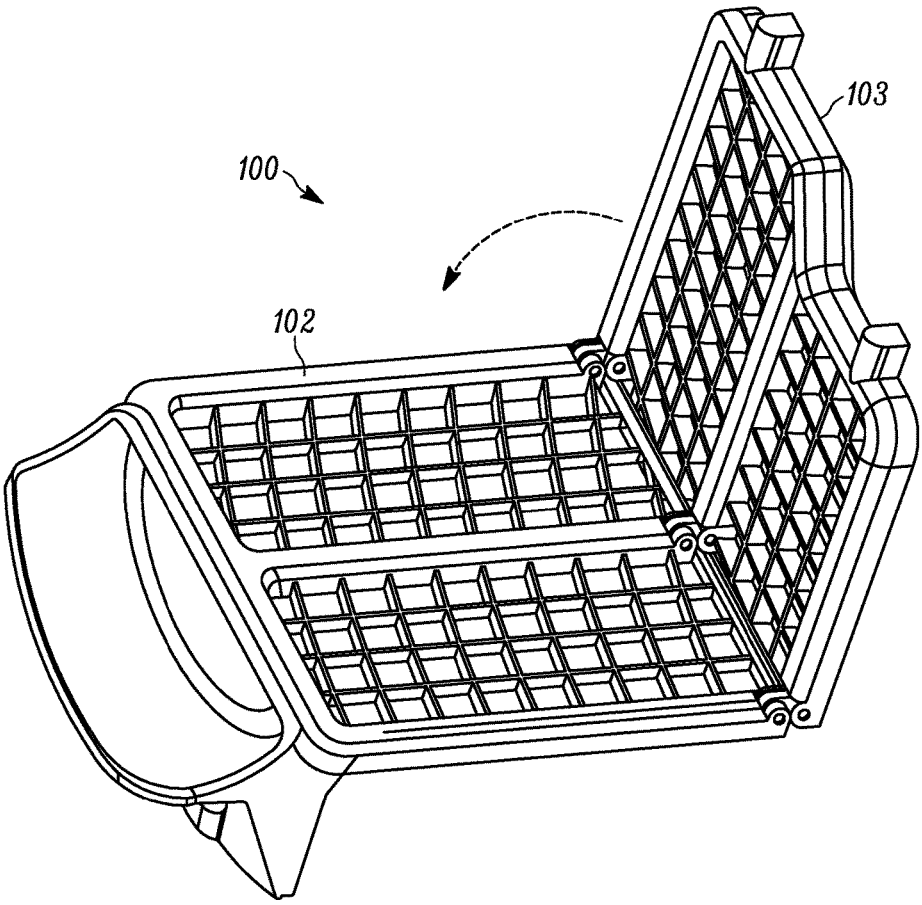
Figure 2B:
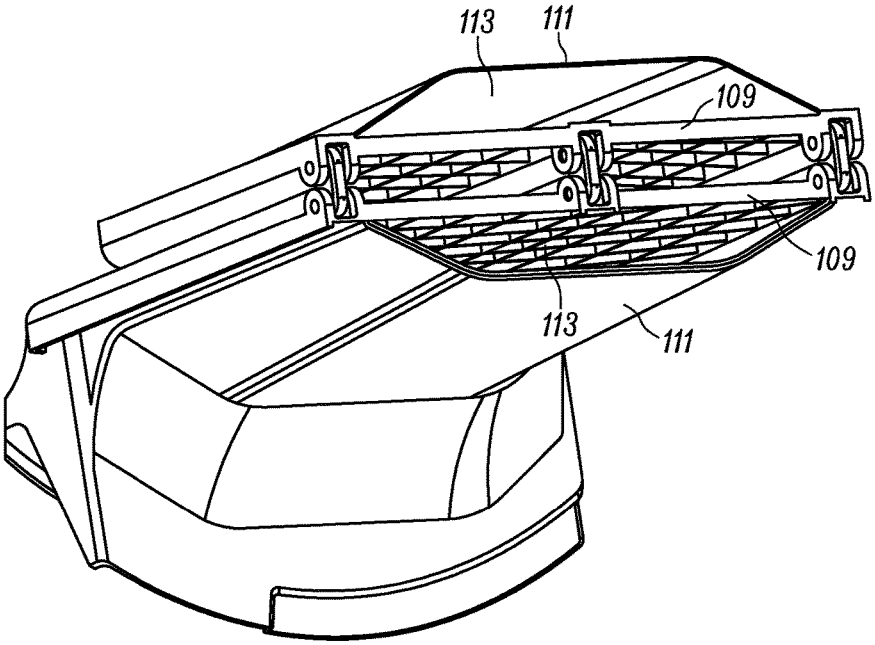
Figure 3:
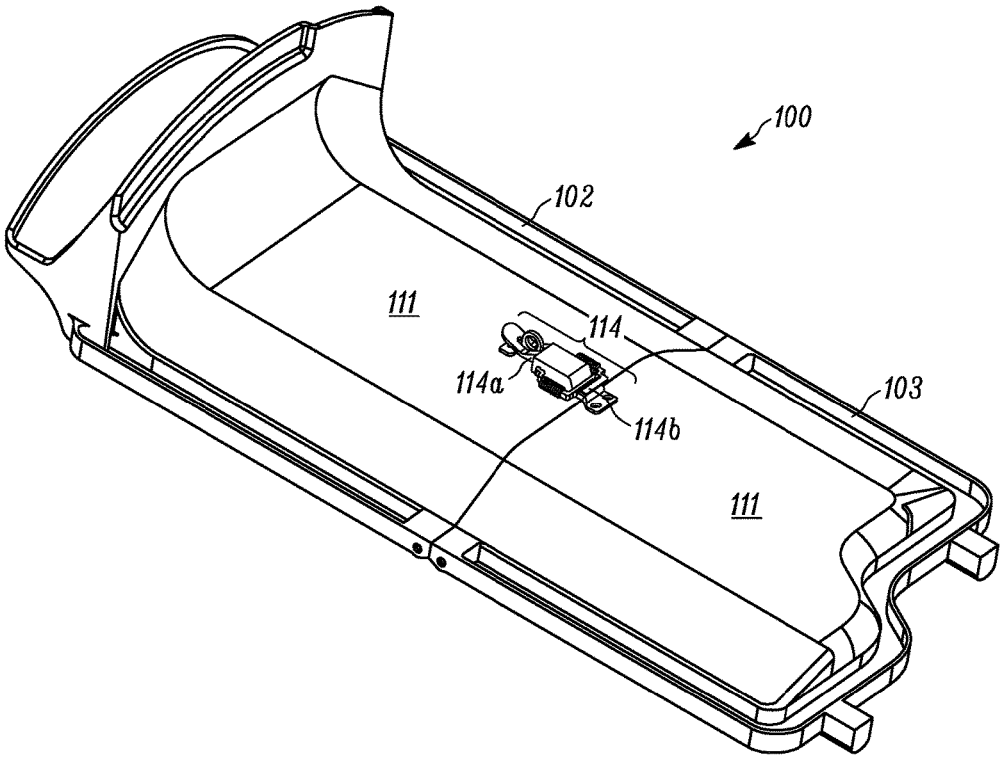
Figure 4:
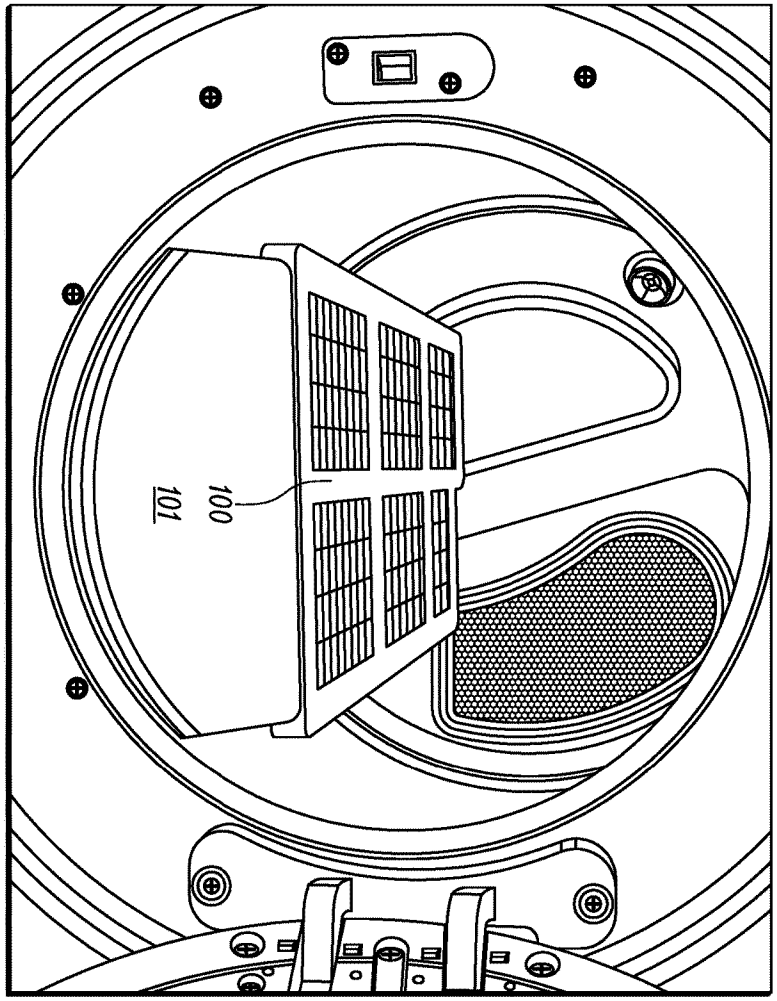
Figure 5:
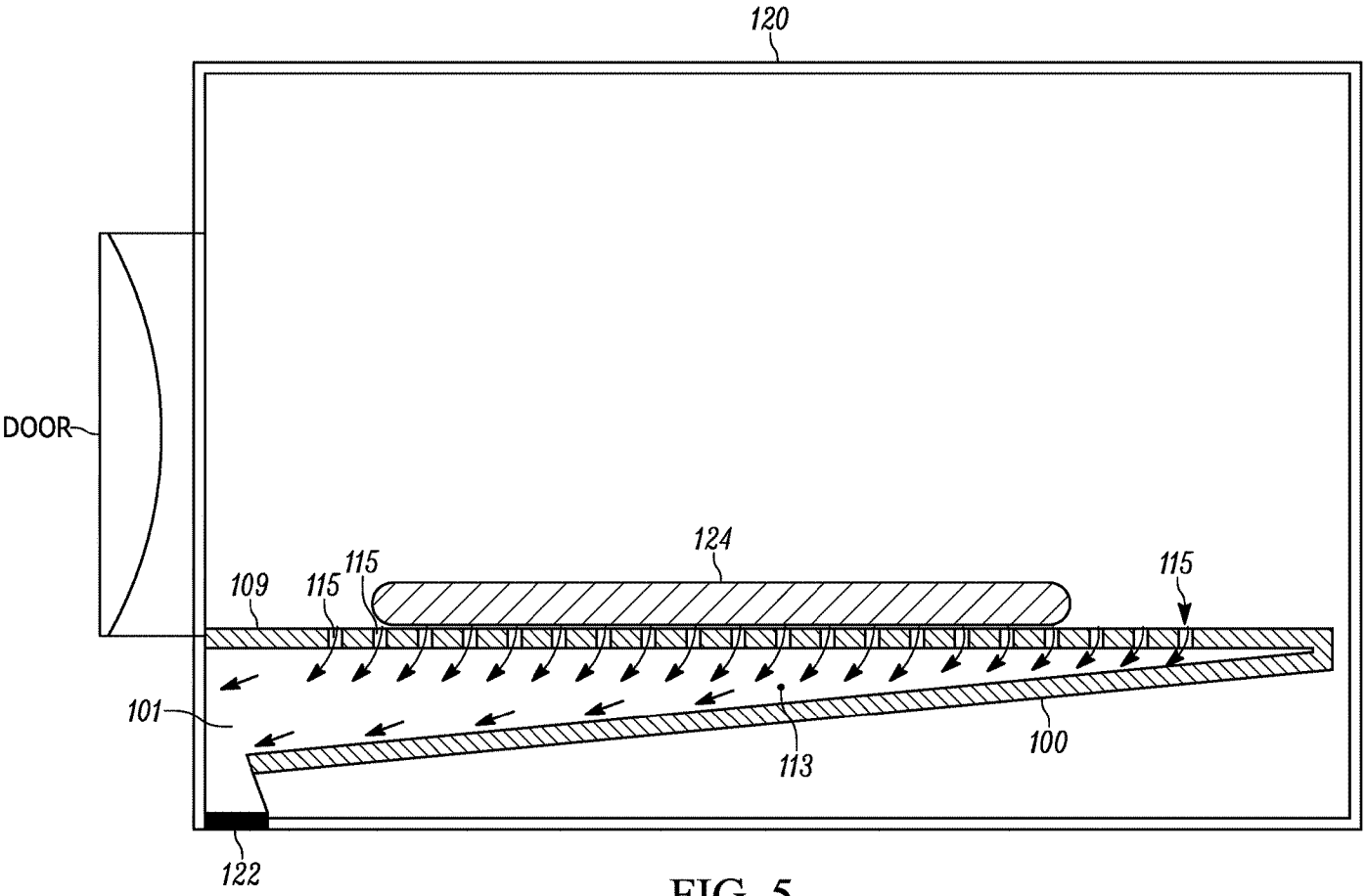

FIGS. 1 through 5 illustrate different views of an example folding drying rack 100 for use with a laundry dryer according to this disclosure. FIG. 1 illustrates a perspective view of the drying rack 100 in an unfolded configuration. FIGS. 2A and 2B show perspective views of the drying rack 100 in a partially folded configuration (FIG. 2A) and a folded configuration (FIG. 2B). FIG. 3 illustrates a perspective view of the drying rack 100 as viewed from another direction. FIGS. 4 and 5 show the drying rack 100 installed in a laundry dryer.

The embodiment of the drying rack 100 shown in FIGS. 1 through 5 is for illustration only. Other embodiments of the drying rack 100 can be used without departing from the scope of this disclosure. Those skilled in the art will recognize that, for simplicity and clarity, some features and components are not explicitly shown in every figure, including those illustrated in connection with other figures. Such features, including those illustrated in other figures, will be understood to be equally applicable to the drying rack 100. It will be understood that all features illustrated in the figures may be employed in any of the embodiments described. Omission of a feature or component from a particular figure is for purposes of simplicity and clarity, and not meant to imply that the feature or component cannot be employed in the embodiments described in connection with that figure.

As shown in FIG. 1, the drying rack 100 is comprised of multiple perforated sections, including a first section 102 and a second section 103. While the drying rack 100 in FIG. 1 includes two sections 102-103, that is merely one example. In other embodiments, the drying rack 100 could include three or more sections. The sections 102-103 are coupled to each other with one or more connectors, such as hinges 106 and hinge pins 107. The hinges 106 and hinge pins 107 allow the drying rack 100 to be oriented unfolded (as shown in FIG. 1), partially folded (as shown in FIG. 2A), or completely folded (as shown in FIG. 2B). That is, the hinges 106 allow freedom of rotation of the sections 102-103 relative to each other from 0 degrees to about 180 degrees. As shown in FIGS. 1-2B, there are three hinges 106 coupling the sections 102-103 together. However, this is merely one example. In other embodiments, there may be more or fewer hinges 106. Also, while FIGS. 1-2B depict hinges 106 and hinge pins 107, other connectors could be employed to couple the sections 102-103, such as flexible plastic or cloth strips, ball-and-socket or ball-and-slot connectors, or any other suitable connector(s).

Each section 102-103 includes multiple walls, including a top wall 109 and a bottom wall 111. Together, the walls 109-111 define a cavity 113 within each section 102-103, as shown more clearly in FIG. 2B. When the drying rack 100 is unfolded (as in FIG. 1), the cavities 113 align and form portions of a channel for airflow, as described in greater detail below. The top wall 109 of each section 102-103 has a generally flat exterior surface and is perforated with openings 115 that extend from an exterior surface of the top wall 109 to the cavity 113. The openings 115 allow air to flow from the surroundings of the drying rack 100 into the cavity 113. As shown in FIG. 1, the openings 115 are generally square or rectangular and are arranged in a grid pattern. The openings 115 are relatively large compared to the total area of the top wall 109. That is, the combined area of the openings 115 comprises a majority of the total area of the top wall 109. Of course, this is merely one example. The openings 115 could have any suitable shape (e.g., circles, squares, elongated slits, etc.) and any suitable arrangement. Also, the openings 115 could have any suitable size and there could be any suitable number of openings 115 in each top wall 109.

As shown in FIG. 1, each of the openings 115 includes walls that are generally perpendicular to the exterior and interior surfaces of the top wall 109, such that the size of each opening 115 is substantially the same at the exterior surface and the interior surface. In other words, each opening 115 does not get smaller or larger as it traverses the top wall 109. In other embodiments, the walls of some or all of the openings 115 may be tapered such that the openings 115 are larger at the exterior surface and smaller at the interior surface. Thus, the openings 115 would be shaped similar to a funnel. Such a configuration can improve airflow and uniform distribution of air throughout the length of the drying rack 100.

As shown more clearly in FIGS. 2B and 3, the bottom wall 111 of each section 102-103 is generally closed without perforations, such that no air can flow through the bottom wall 111. The bottom wall 111 includes one or more substantially flat portions arranged at angles to each other, such as shown in FIG. 2B, or the bottom wall 111 can be a curved wall. Additionally or alternatively, the sections 102-103 may include one or more side walls. In general, any configuration of flat or curved walls or wall portions could be used in conjunction with the top wall 109 in order to define the cavity 113. In some embodiments, the configuration of the walls could be designed to promote uniform distribution of air flow throughout the length of the cavity 113.

The first section 102 of the drying rack 100 includes an air outlet cover 101 at the end opposite the hinges 106. The second section 103 includes rear supports 104-105 at the end opposite the hinges 106. When the drying rack 100 is installed in the laundry dryer 120, as shown in FIGS. 4 and 5, the drying rack 100 extends across the drum of the dryer 120 from the front of the dryer 120 to the back of the dryer 120. The air outlet cover 101 substantially covers the air outlet 122 (sometimes referred to as the "vent") of the dryer 120. The rear supports 104-105 are peg-like structures that fit into locating recesses, holes, or dimples on the rear wall of the dryer drum and act to support the rear end of the drying rack 100.

In FIG. 3, the bottom side of the drying rack 100 can be clearly seen. The drying rack 100 includes a fastener 114 attached to the bottom walls 111. The fastener 114 includes two portions—a first fastener portion 114*a* on the first section 102 and a second fastener portion 114*b* on the second section 103. The two fastener portions 114*a*-114*b* couple to lock the drying rack 100 in an unfolded arrangement. The fastener portions 114*a*-114*b* can be released from each other so that the drying rack 100 can be folded for compact storage. As shown in FIG. 3, the fastener 114 is a latch. However, this is merely one example. Any suitable fastener could be used, including a buckle, clasp, or snap.

In one aspect of operation, the drying rack 100 is unfolded (as shown in FIG. 1) and locked in the unfolded configuration using the fastener 114. Then the drying rack 100 is installed in the laundry dryer as shown in FIGS. 4 and 5, with the air outlet cover 101 substantially covering the air outlet 122 of the dryer 120. One or more items 124 to be dried (e.g., a sweater) are placed on the top surface of the drying rack 100 (e.g., positioned over at least some of the openings 115), and then the dryer 120 is started. When the dryer 120 operates, air enters the dryer drum creating a high pressure area inside the drum. The pressure difference between the drum and the air outlet 122 draws air over the item(s) 124, through the openings 115, and into the cavities 113, which form an airflow channel. Then the air moves through at least a portion of the channel to the air outlet 122 of the dryer 120. The concentrated air movement through the channel of the drying rack 100 results in faster and more voluminous air movement in the vicinity of the item(s) 124, which in turn results in a much faster drying time.

Figure 6:
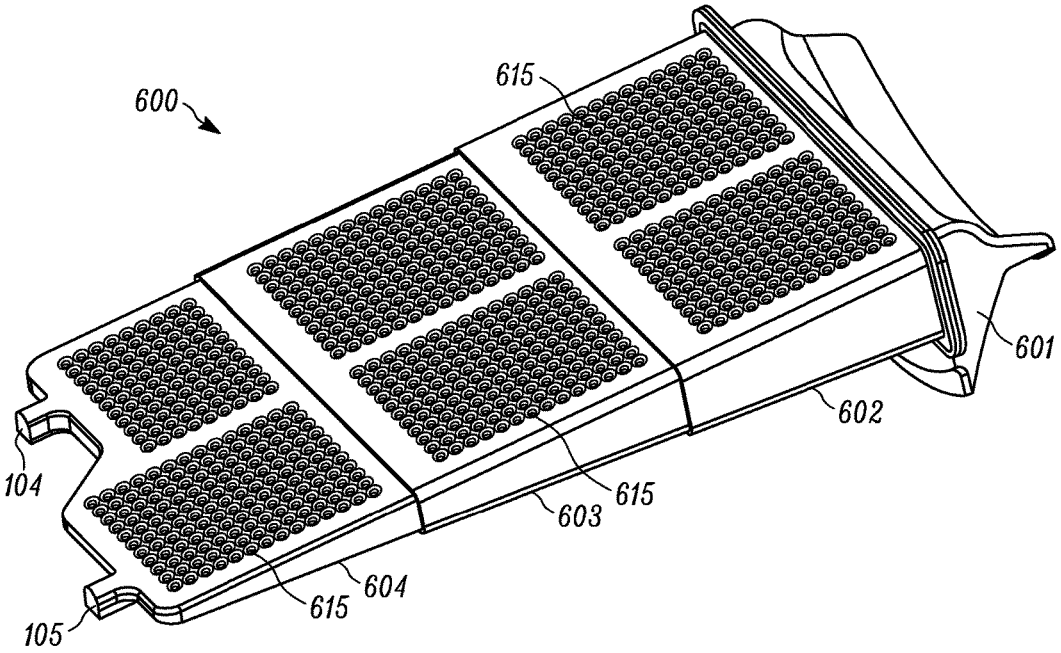
FIG. 6 illustrates another example drying rack for use with a laundry dryer according to this disclosure.

FIG. 6 illustrates another example drying rack 600 for use with a laundry dryer according to this disclosure. The drying rack 600 shown in FIG. 6 includes a number of components that are the same as or similar to corresponding components of the drying rack 100 of FIGS. 1 through 5; for the purposes of simplicity and clarity of the various embodiments, a detailed description of those elements are not repeated here.

As shown in FIG. 6, the drying rack 600 is comprised of multiple perforated sections, including a first section 602, a second section 603, and a third section 604. While the drying rack 600 in FIG. 6 includes three sections 602-604, that is merely one example. In other embodiments, the drying rack 600 could include more or fewer sections. The first section 602 of the drying rack 600 includes an air outlet cover 601, the same as or similar to the air outlet cover 101 of FIG. 1. Each of the sections 602-604 include a top wall perforated with multiple openings 615 that can be the same as or similar to the openings 115 of FIG. 1. As shown in FIG. 6, the openings 615 are smaller than the openings 115 of FIG. 1. Of course, this is merely one example. The openings 615 could have any suitable shape (e.g., circles, squares, elongated slits, etc.) and any suitable arrangement. Also, the openings 615 could have any suitable size and there could be any suitable number of openings 615 in each section 602-604.

Rather than being hinged together like the sections 102-103 of FIG. 1, the sections 602-604 shown in FIG. 6 are slidably coupled and slide together like sections of a telescope. That is, the third section 604 slides into the cavity of the second section 603, and the second section 603 slides into the cavity of the first section 602. Thus, the sections 602-604 nest inside each other for compact, convenient storage. When the drying rack 600 is ready to be installed in the laundry dryer, the sections 602-604 slide out telescopically until the sections 602-604 are in the configuration shown in FIG. 6. One or more stop structures (not shown) keep the sections 602-604 from separating completely. In this configuration, the drying rack 600 can be installed in the dryer and used in a manner the same as or similar to that described earlier in conjunction with the drying rack 100.

FIGS. 7 through 11 illustrate yet another example drying rack 700 for use with a laundry dryer according to this disclosure. The drying rack 700 shown in FIGS. 7 through 11 includes a number of components that are the same as or similar to corresponding components of the drying racks 100, 600; for the purposes of simplicity and clarity of the various embodiments, a detailed description of those elements are not repeated here.

Figure 7:
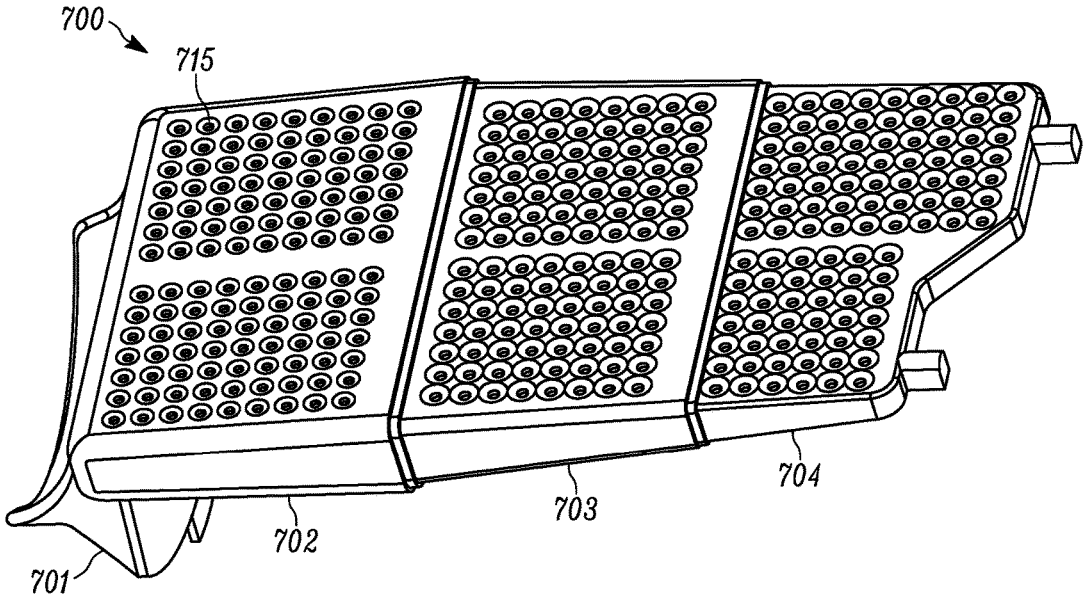
FIGS. 7 through 11 illustrate yet another example drying rack for use with a laundry dryer according to this disclosure.

As shown in FIG. 7, the drying rack 700 is comprised of multiple perforated sections, including a first section 702, a second section 703, and a third section 704. While the drying rack 700 includes three sections 702-704, that is merely one example. In other embodiments, the drying rack 700 could include more or fewer sections. The first section 702 of the drying rack 700 includes an air outlet cover 701, the same as or similar to the air outlet cover 101 of FIG. 1. Each of the sections 702-704 include a top wall perforated with multiple openings 715 that can be the same as or similar to the openings 115 of FIG. 1.

Figure 8:
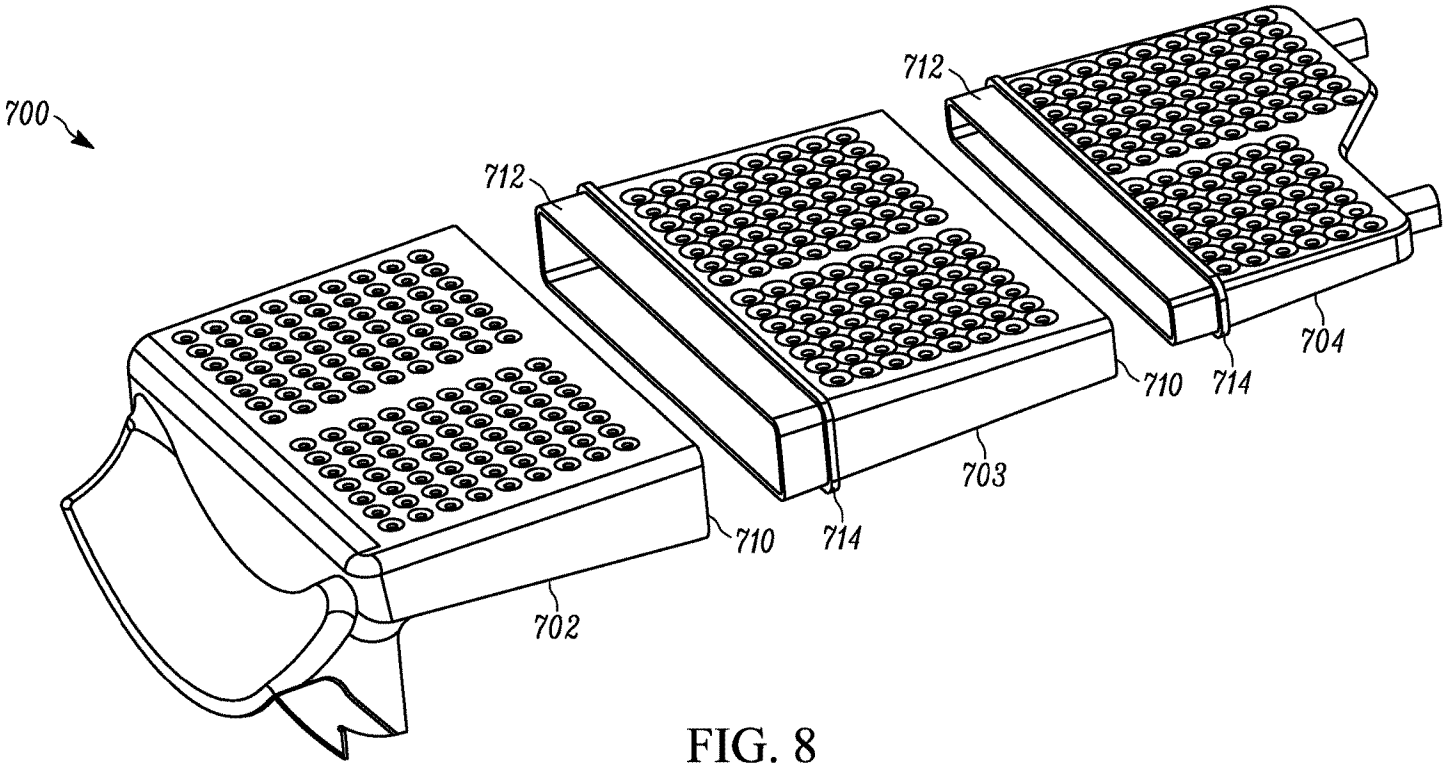

Rather than being hinged together (like the sections 102-103 of the drying rack 100) or slidably coupled (like the sections 602-604 of the drying rack 600), the sections 702-704 of the drying rack 700 are completely separable, as shown in FIG. 8. For assembly of the drying rack 700, the cavities of the first section 702 and the second section 703 include smooth interior surfaces 710, while the second section 703 and the third section 704 include smooth outer surfaces 712. The outer surfaces 712 are just smaller than the interior surfaces 710 such that the outer surfaces 712 can be inserted snugly into the interior surfaces 710. Shoulders 714 on the second section 703 and the third section 704 keep the sections 703-704 from being inserted too far into the adjacent section 702-703. Friction between the snug surfaces 710-712 keeps the sections 702-704 from separating once assembled, unless the sections 702-704 are pulled apart.

Figure 9:
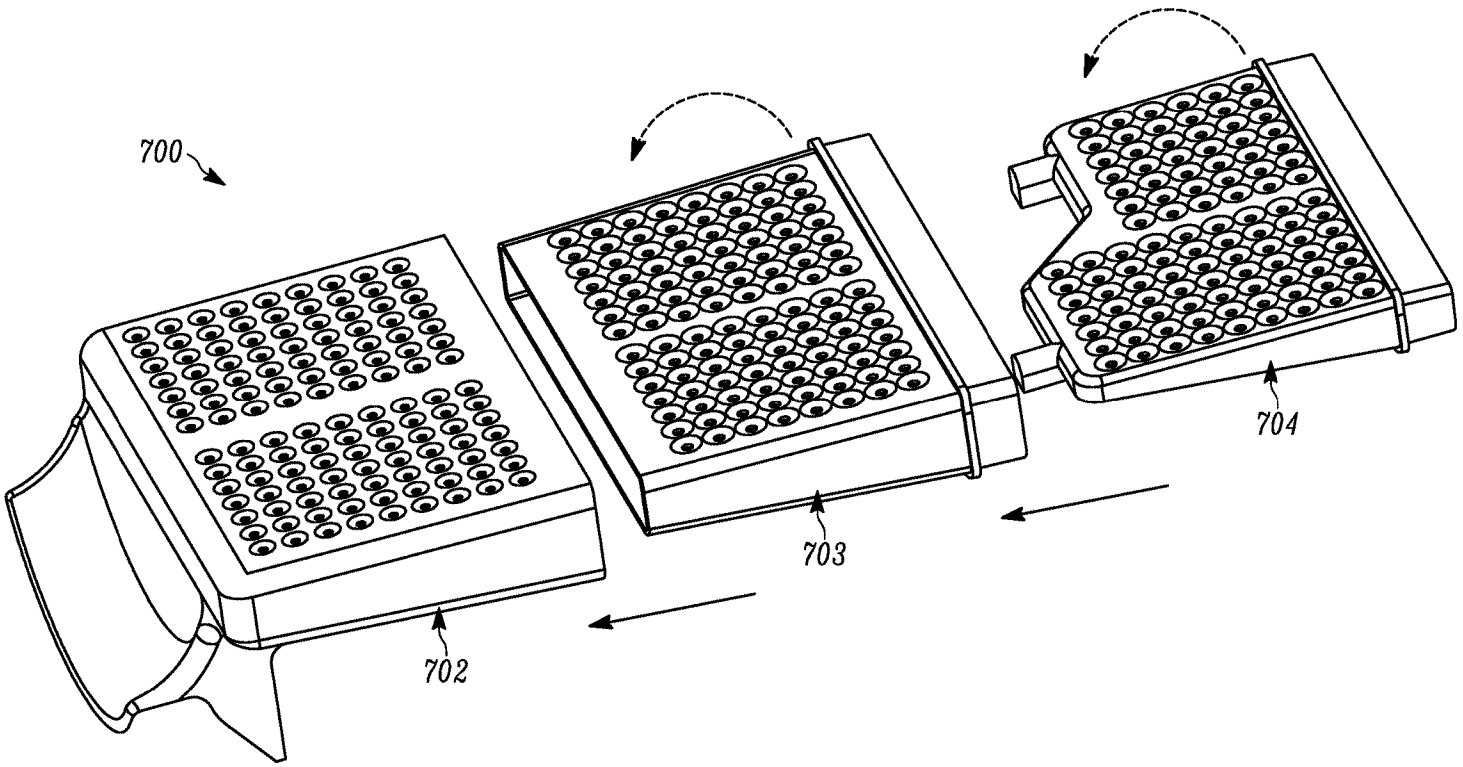
Figure 10:
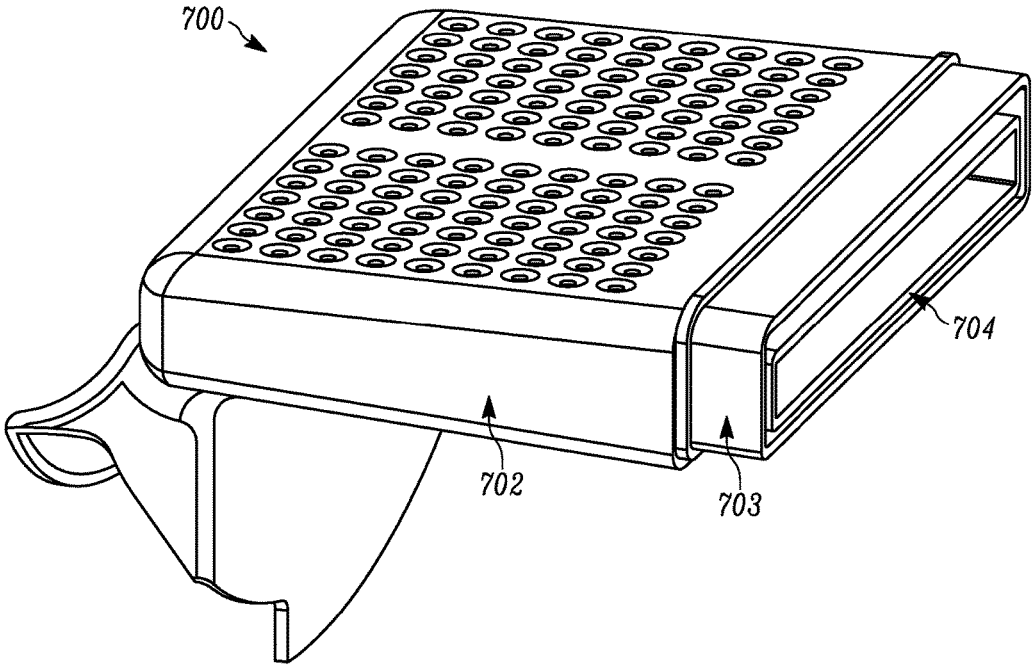
Figure 11:
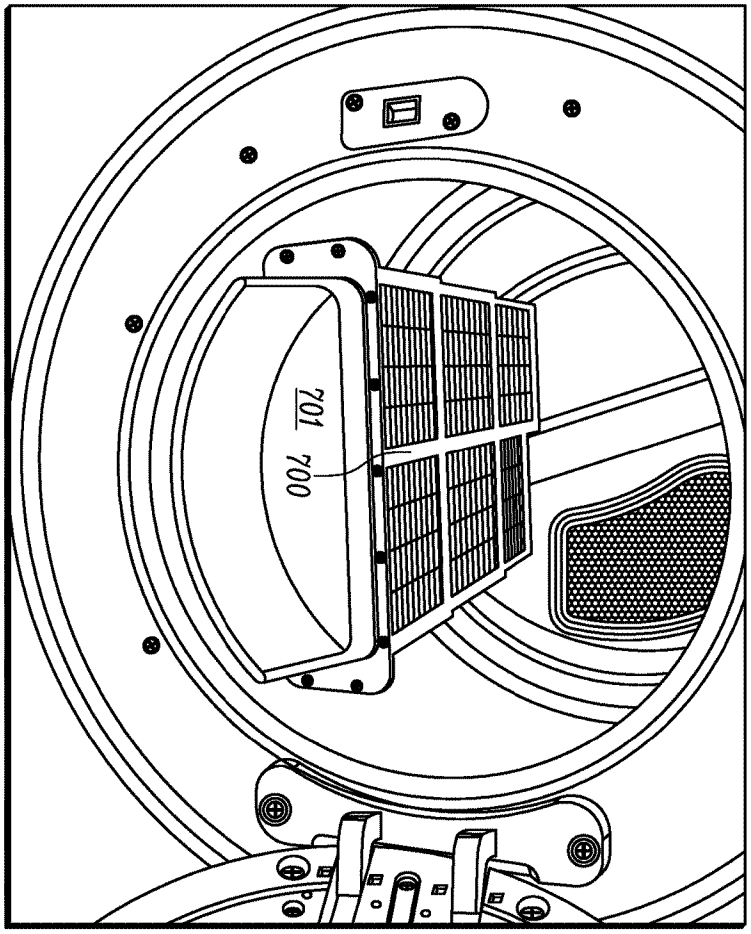

In the configuration shown in FIG. 7, the drying rack 700 can be installed in the dryer and used in a manner the same as or similar to that described earlier in conjunction with the drying rack 100. FIG. 11 shows the drying rack 700 installed in a dryer. For storage of the drying rack 700, the sections 702-704 can be separated as shown in FIG. 8. Then, the second section 703 and the third section 704 can be turned 180 degrees, as shown in FIG. 9. Then, the second section 703 can be inserted into the cavity of the first section 702, and the third section 704 can be inserted into the cavity of the second section 703, as shown in FIG. 10. Thus, the sections 702-704 nest inside each other for compact, convenient storage, similar to the drying rack 600 of FIG. 6.

Figure 12:
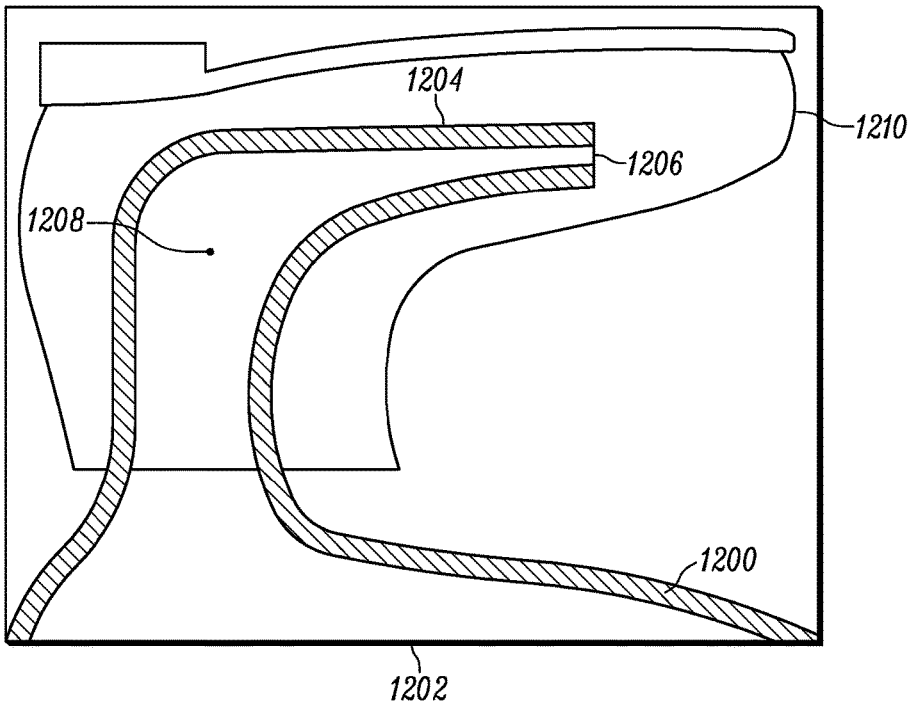
FIG. 12 illustrates a cross-sectional view of an example shoe stand configured for use with a drying rack according to this disclosure.

FIG. 12 illustrates a cross-sectional view of an example shoe stand 1200 configured for use with a drying rack according to this disclosure. The embodiment of the shoe stand 1200 shown in FIG. 12 is for illustration only. Other embodiments of the shoe stand 1200 can be used without departing from the scope of this disclosure.

The shoe stand 1200 is used with a drying rack (such as any of the drying racks 100, 600, 700) to improve drying of a shoe in a laundry dryer. As shown in FIG. 12, the shoe stand 1200 has a bottom surface 1202, an upper surface 1204, and a nose 1206. Surrounding walls of the shoe stand 1200 define a cavity 1208 that extends from the nose 1206 to the bottom surface 1202. A small opening at the nose 1206 and a large opening at the bottom surface 1202 result in an airflow channel through the cavity 1208. In some embodiments, the nose 1206 can include multiple small openings. In some embodiments, the multiple small openings can be oriented in different directions to promote better airflow coverage.

The shoe stand 1200 is sized such that a shoe 1210 can be placed over the top portion of the shoe stand 1200, such that the inside of the shoe 1210 rests on the upper surface 1204. In some embodiments, the shoe stand 1200 may be configured in different sizes, such as sizes for children's shoes and adult shoes. Once the shoe 1210 is placed over the shoe stand 1200, the shoe stand 1200 and the shoe 1210 can be positioned on a drying rack in a dryer for faster shoe drying. In some embodiments, the shoe stand 1200 may include one or more placement pegs and the drying rack may include one or more peg holes, or vice versa. The peg holes receive the placement pegs to promote stability of the shoe stand 1200 and to properly align the shoe stand 1200 on the drying rack. In other embodiments, slots, grooves, or other suitable alignment constructs may be used instead of pegs and peg holes.

Figure 13:
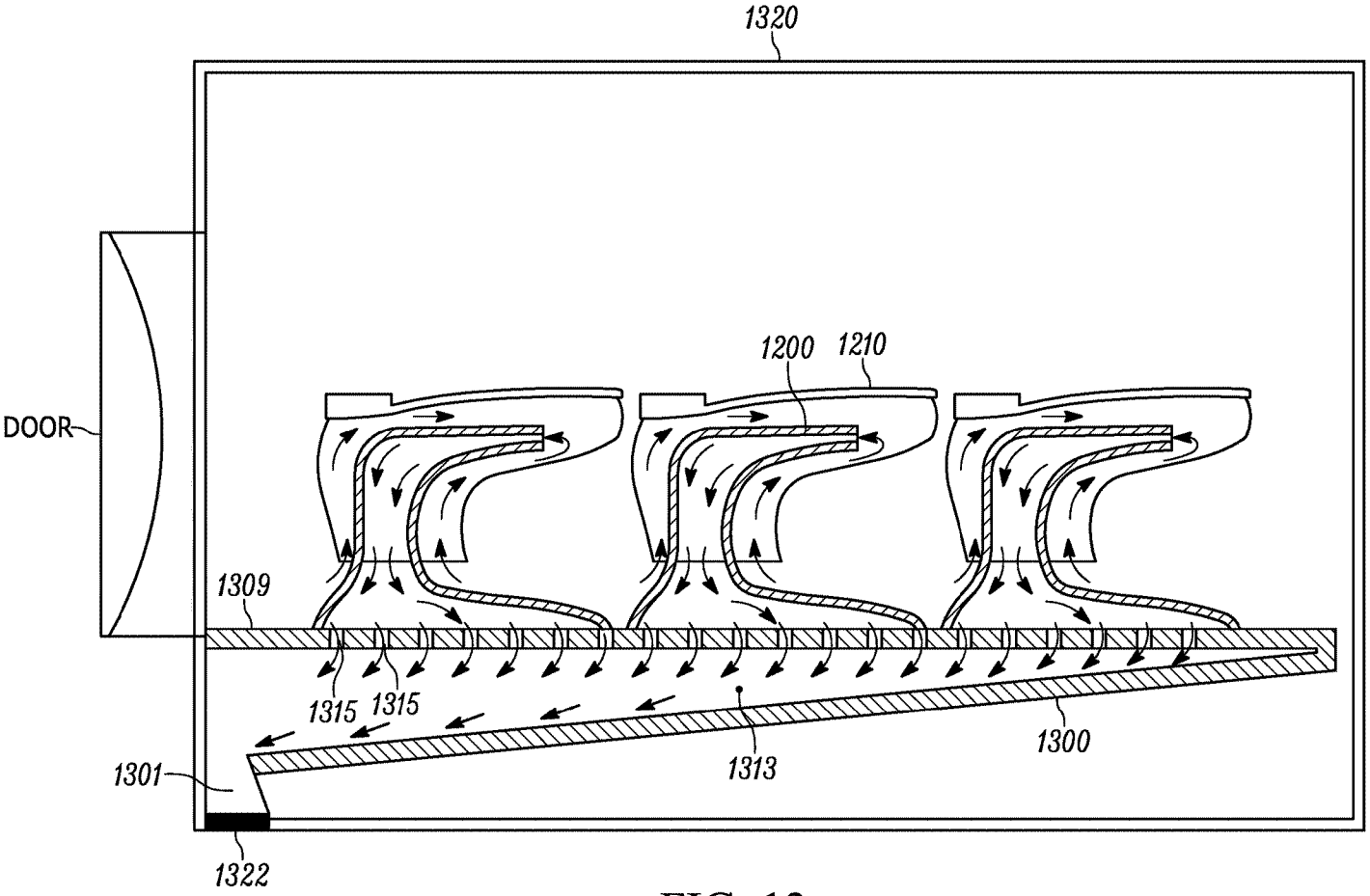
FIG. 13 illustrates multiple shoe stands arranged on a drying rack inside a laundry dryer according to this disclosure.

FIG. 13 illustrates multiple shoe stands 1200 arranged on a drying rack 1300 inside a laundry dryer 1320 according to this disclosure. The embodiment shown in FIG. 13 is for illustration only. Other embodiments of the shoe stands 1200 with a drying rack can be used without departing from the scope of this disclosure.

As shown in FIG. 13, three shoe stands 1200 are positioned side by side on the drying rack 1300 in the laundry dryer 1320. The drying rack 1300 may represent (or be represented by) any of the drying racks 100, 600, 700 described earlier. The drying rack 1300 includes a top wall 1309 that has multiple openings 1315, such as described earlier. The drying rack 1300 also includes a cavity 1313 and an air outlet cover 1301 that substantially covers an air outlet 1322 of the dryer.

Each shoe stand 1200 is positioned over some of the openings 1315 in the top wall 1309 of the drying rack 1300. While three shoe stands 1200 are shown in FIG. 13, that is merely one example. In other embodiments, more or fewer shoe stands 1200 can be positioned on the drying rack 1300.

When the dryer 1320 operates, air enters the dryer drum creating a high pressure area inside the drum. The pressure difference between the drum and the air outlet 1322 draws air inside the shoe 1210, through the shoe 1210, and into the small opening at the nose 1206 of the shoe stand 1200, as indicated by the arrows in FIG. 13. The air then flows down through the cavity 1208 of the shoe stand, through the openings 1315, into the cavity 1313 of the drying rack 1300, and then to the air outlet 1322 of the dryer 1320. The concentrated air movement through the interior of the shoe 1210 results in a faster drying time.

Although the figures illustrate different examples of drying racks and shoe stands, various changes may be made to the figures. For example, the drying racks and shoe stands shown can include any number of each component in any suitable arrangement. In general, the figures do not limit the scope of this disclosure to any particular configuration(s). Moreover, while figures illustrate operational environments in which various drying features disclosed in this patent document can be used, these features can be used in any other suitable system.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A drying apparatus for use with a laundry dryer, the drying apparatus comprising:

a first section and a second section, each section having a plurality of walls defining a cavity, the cavity comprising a portion of a channel for air flow, a first wall among the plurality of walls having a substantially flat exterior surface and a plurality of openings extending through the first wall from the exterior surface to the portion of the channel, wherein the first section and the second section are connected by either a hinge or telescopically, wherein the first section and the second section are configured to be disposed substantially adjacent to each other to form the channel, and wherein the first section comprises an air outlet cover at a first end, the air outlet cover configured to substantially cover an air outlet of the laundry dryer.

2. The drying apparatus of claim 1, wherein the drying apparatus is configured such that when the drying apparatus is installed in the laundry dryer, the substantially flat exterior surface for both of the first and second sections are oriented upward and configured to support an object to be dried.

3. The drying apparatus of claim 1, wherein the drying apparatus is configured such that when the drying apparatus is installed in the laundry dryer and the laundry dryer is operating, the drying apparatus provides an air flow path through the openings in the first wall for each of the first and second sections, through at least a portion of the channel, through the air outlet cover, and into the air outlet of the laundry dryer.

4. The drying apparatus of claim 1, wherein the first section and the second section are coupled with at least one hinge, the drying apparatus configured to fold and unfold at the at least one hinge.

5. The drying apparatus of claim 4, wherein the first wall of the first section faces the first wall of the second section when the drying apparatus is folded.

6. The drying apparatus of claim 4, wherein:

a second surface of the first section comprises a first fastener portion and a second surface of the second section comprises a second fastener portion, and the first fastener portion and the second fastener portion are configured to couple together to secure the first section to the second section when the drying apparatus is unfolded.

7. The drying apparatus of claim 1, wherein the second section is configured to translate telescopically in and out of the cavity of the first section.

8. The drying apparatus of claim 7, further comprising a third section configured to translate telescopically in and out of the cavity of the second section.

9. The drying apparatus of claim 1, further comprising a third section having a plurality of walls defining a cavity, wherein the first, second, and third sections are configured such that:

when the second and third sections are oriented in a first direction relative to the first section, the first, second, and third sections are configured to couple together linearly to form the channel, and when the second and third sections are oriented in a second direction opposite the first direction, the second and third sections are configured to nest inside the cavity of the first section.

10. The drying apparatus of claim 1, wherein one or more of the plurality of openings has tapered sides such that a cross section of the one or more of the plurality of openings at the exterior surface is larger than a cross section of the one or more of the plurality of openings at an interior surface.

11. The drying apparatus of claim 1, wherein the second section includes at least one support configured to engage with a recess on a rear wall of a drum of the laundry dryer to support the drying apparatus in a fixed position.

12. The drying apparatus of claim 1, further comprising a shoe stand configured to rest on the substantially flat exterior surface of at least one of the first wall of the first section or the first wall of the second section.

13. A laundry dryer comprising:

a drum;

an air outlet; and a removable drying rack configured to be installed inside the drum, the drying rack comprising:

a first section and a second section, each section having a plurality of walls defining a cavity, the cavity comprising a portion of a channel for air flow, a first wall among the plurality of walls having a substantially flat exterior surface and a plurality of openings extending through the first wall from the exterior surface to the portion of the channel, wherein the first section and the second section are connected by either a hinge or telescopically, wherein the first section and the second section are configured to be disposed substantially adjacent to each other to form the channel, and wherein the first section comprises an outlet cover at a first end, the outlet cover configured to substantially cover the air outlet.

14. The laundry dryer of claim 13, wherein the drying rack is configured such that when the drying rack is installed in the laundry dryer, the substantially flat exterior surface for both of the first and second sections are oriented upward and configured to support an object to be dried.

15. The laundry dryer of claim 13, wherein the drying rack is configured such that when the drying rack is installed in the laundry dryer and the laundry dryer is operating, the drying rack provides an air flow path through the openings in the first wall for each of the first and second sections, through at least a portion of the channel, through the outlet cover, and into the air outlet.

16. The laundry dryer of claim 13, wherein the first section and the second section are coupled with at least one hinge, the drying rack configured to fold and unfold at the at least one hinge.

17. The laundry dryer of claim 16, wherein the first wall of the first section faces the first wall of the second section when the drying rack is folded.

18. The laundry dryer of claim 16, wherein:

a second surface of the first section comprises a first fastener portion and a second surface of the second section comprises a second fastener portion, and the first fastener portion and the second fastener portion are configured to couple together to secure the first section to the second section when the drying rack is unfolded.

19. The laundry dryer of claim 13, wherein the second section is configured to translate telescopically in and out of the cavity of the first section.

20. The laundry dryer of claim 19, further comprising a third section configured to translate telescopically in and out of the cavity of the second section.

* * * * *